US006073640A

United States Patent [19]

McTaggart

[11] Patent Number: 6,073,640

[45] Date of Patent: Jun. 13, 2000

[54] PART WASHER

[75] Inventor: Michael Douglas McTaggart, Windsor, Canada

[73] Assignee: Valiant Machine & Tool Inc., Canada

[21] Appl. No.: 09/065,700

[22] Filed: Apr. 24, 1998

[51] Int. Cl.[7] ..... B08B 3/00

[52] U.S. Cl. ..... 134/103.1; 134/133; 134/155; 134/201

[58] Field of Search ..... 134/902, 133, 134/186, 103.1, 130, 155, 201, 111

[56] References Cited

U.S. PATENT DOCUMENTS

| | | | |
|---|---|---|---|
| 1,029,541 | 6/1912 | Haustetter | 134/111 |
| 1,327,444 | 1/1920 | Phillips | 134/133 |
| 2,006,085 | 6/1935 | Lehmkuhl | 134/103.1 |
| 3,441,035 | 4/1969 | Edwards . | |
| 3,443,567 | 5/1969 | Moore . | |
| 3,923,072 | 12/1975 | Beaud | 134/111 |
| 4,162,680 | 7/1979 | Coch | 134/186 |
| 4,694,527 | 9/1987 | Yoshizawa | 134/902 |
| 4,934,392 | 6/1990 | Henfrey | 134/186 |
| 5,881,748 | 3/1999 | Suzuki . | |

*Primary Examiner*—Frankie L. Stinson

*Attorney, Agent, or Firm*—Gifford, Krass, Groh, Sprinkle, Anderson & Citkowski, P.C.

[57] ABSTRACT

An industrial part washer is disclosed having a washer housing with an upper chamber, a lower chamber, and a fluid passageway connecting the chambers together. A fluid drain is connected to a lower chamber for draining fluid from it while a pump pumps a cleaning fluid into the upper chamber. A flood valve is positioned in the fluid passageway between the upper and lower chambers and this valve is movable between an open and a closed position. Parts are sequentially moved into a position adjacent the washer housing and are selectively loaded into the lower chamber, washed and, following completion of a wash cycle, subsequently unloaded from the lower chamber. A valve control closes the flood valve during the loading and unloading operations of the part into the lower chamber so that, during the loading and unloading portions of the wash cycle, the upper chamber at least partially and preferably completely fills with the cleaning fluid.

15 Claims, 3 Drawing Sheets

PART WASHER

BACKGROUND OF THE INVENTION

I. Field of the Invention

The present invention relates to an industrial part washer.

II. Description of the Prior Art

In industrial manufacturing facilities, for example, the manufacture of automotive engine blocks or cylinder heads, it is necessary to thoroughly wash the completed part prior to final assembly. Such washing of the final part removes not only foundry sand and other debris as the result of casting operations, but also metal chips and debris entrapped within cavities, openings, etc. present in the part from machining operations.

There has been many previously known part washers for washing such industrial parts. These previously known part washers typically comprise a washer housing having a conveyor which sequentially moves parts through the washing housing. Numerous spray jets are contained within the washing housing and have their outlets directed at the parts on the conveyor line. A pump pumps pressurized cleaning fluid, typically water, through the jets such that the fluid streams impinge upon the parts and wash debris contained within the parts away from the parts.

These previously known part washers, however, have suffered from several disadvantages. One disadvantage is that the fluid jets are not wholly effective in removing all of the debris from the finished part. Furthermore, any debris which is not removed from the finished part can result in failure of the completed assembly in operation.

A still further disadvantage of these previously known part washers is that such part washers are large in construction and thus require a relatively large amount of floor space. Furthermore, such previously known part washers are expensive in construction.

SUMMARY OF THE PRESENT INVENTION

The present invention provides a part washer for industrial parts which overcomes all of the above-mentioned disadvantages of the previously known devices.

In brief, the part washer of the present invention comprises a washer housing having an upper chamber, a lower chamber and a fluid passageway connecting the two chambers together. A drain is fluidly connected to the lower chamber for draining fluid from the lower chamber. Preferably, a drain valve movable between an open and closed position is fluidly connected in series with the drain.

A flood valve is contained within the fluid passageway and is movable between an open and closed position while a fluid pump continuously pumps a cleaning fluid, typically water, into the upper chamber. Consequently, with the flood valve in the closed position, the upper chamber fills with the cleaning fluid. Conversely, with the flood valve in an open position and the drain valve in a closed position, the cleaning fluid in the upper chamber empties from the upper chamber and floods the lower chamber.

The parts to be washed are sequentially moved by a conveyor system to a position adjacent the lower chamber. A shuttle assembly movable between a retracted position and an extended position selectively engages the part adjacent the lower chamber and moves the part laterally through an opening in the lower chamber thus positioning the part in the lower chamber. Once the part is positioned within the lower chamber, a plate on the shuttle assembly closes the opening in the lower chamber and effectively seals the housing.

A plurality of fluid jets are contained within the lower chamber and have their output directed toward the interior of the lower chamber and thus generally towards the part when loaded within the lower chamber. An agitator is also preferably connected to the shuttle assembly for reciprocally agitating the part when the part is positioned within the lower chamber.

During the operation of a complete cycle, a part is first moved to a load position adjacent the lower chamber. At this time, the flood valve is closed so that the upper chamber is being filled by the cleaning fluid while the drain valve is open thus draining the cleaning fluid from the lower chamber.

At this time, the shuttle assembly is in its retracted position. The shuttle assembly then selectively engages the part and moves to its extended position. In doing so, the shuttle assembly moves the part from the conveyor and into the lower chamber. Simultaneously, the plate on the shuttle assembly closes the opening in the lower chamber.

Once the part is positioned within the lower chamber, the drain valve is closed and the flood valve is opened thus immediately flooding the lower chamber and immersing the part with the cleaning fluid. The fluid jets contained within the lower chamber are actuated and the part is simultaneously agitated within the lower chamber. In doing so, any debris contained within or on the part is removed from the part.

During cycle the drain valve can be cycled to escape chips.

Following completion of the wash cycle, the flood valve is again closed and the drain valve opened thus removing the cleaning fluid and any debris from the lower chamber and simultaneously the pump begins to fill the upper chamber with the cleaning fluid. The shuttle assembly is then moved to its retracted position again placing the part on the conveyor system. The conveyor system then moves the next sequential part into the load position adjacent the lower chamber and the above-described process is repeated.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
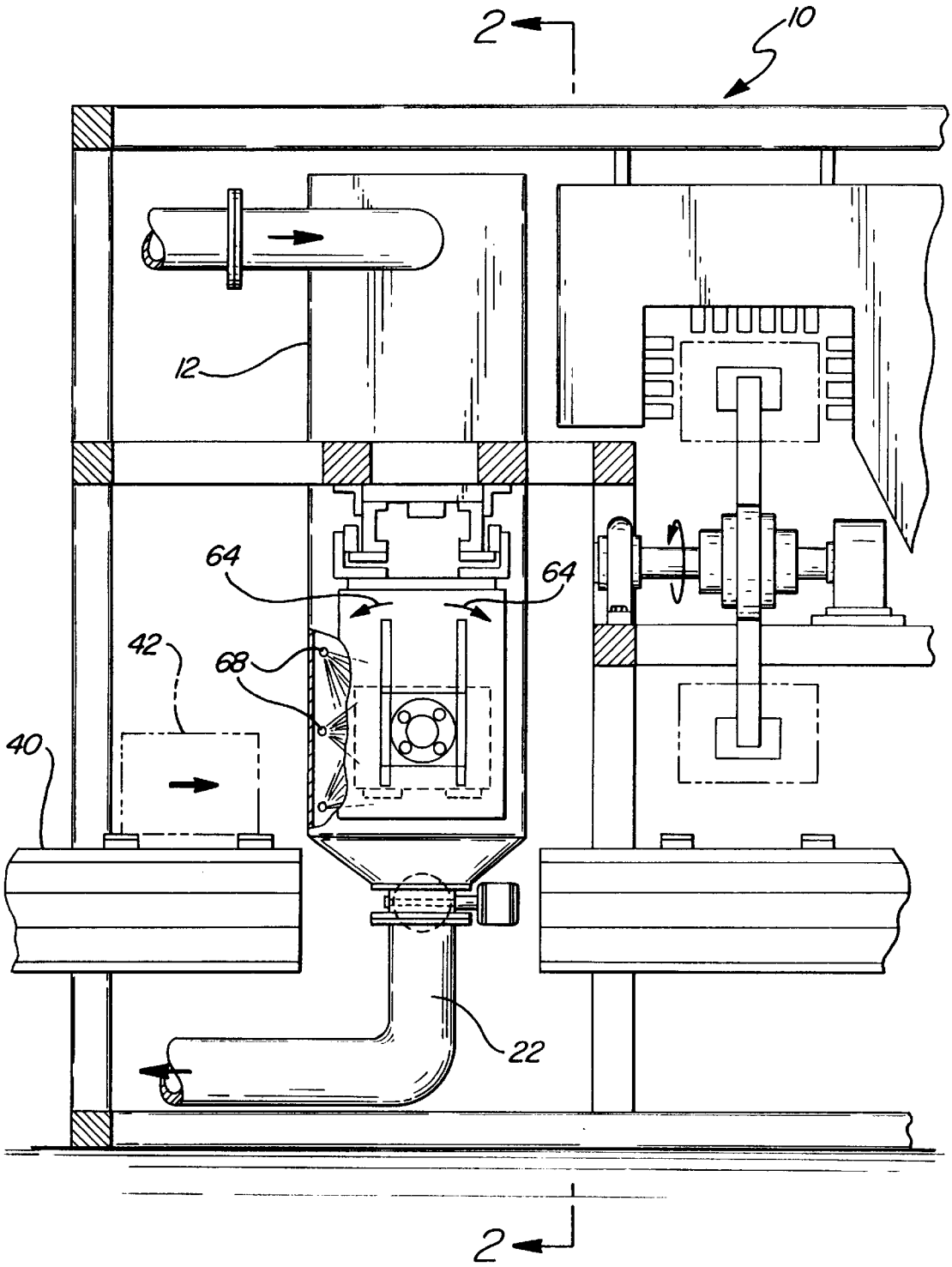
FIG. 1 is a diagrammatic side view illustrating a preferred embodiment of the present invention.
Figure 2:
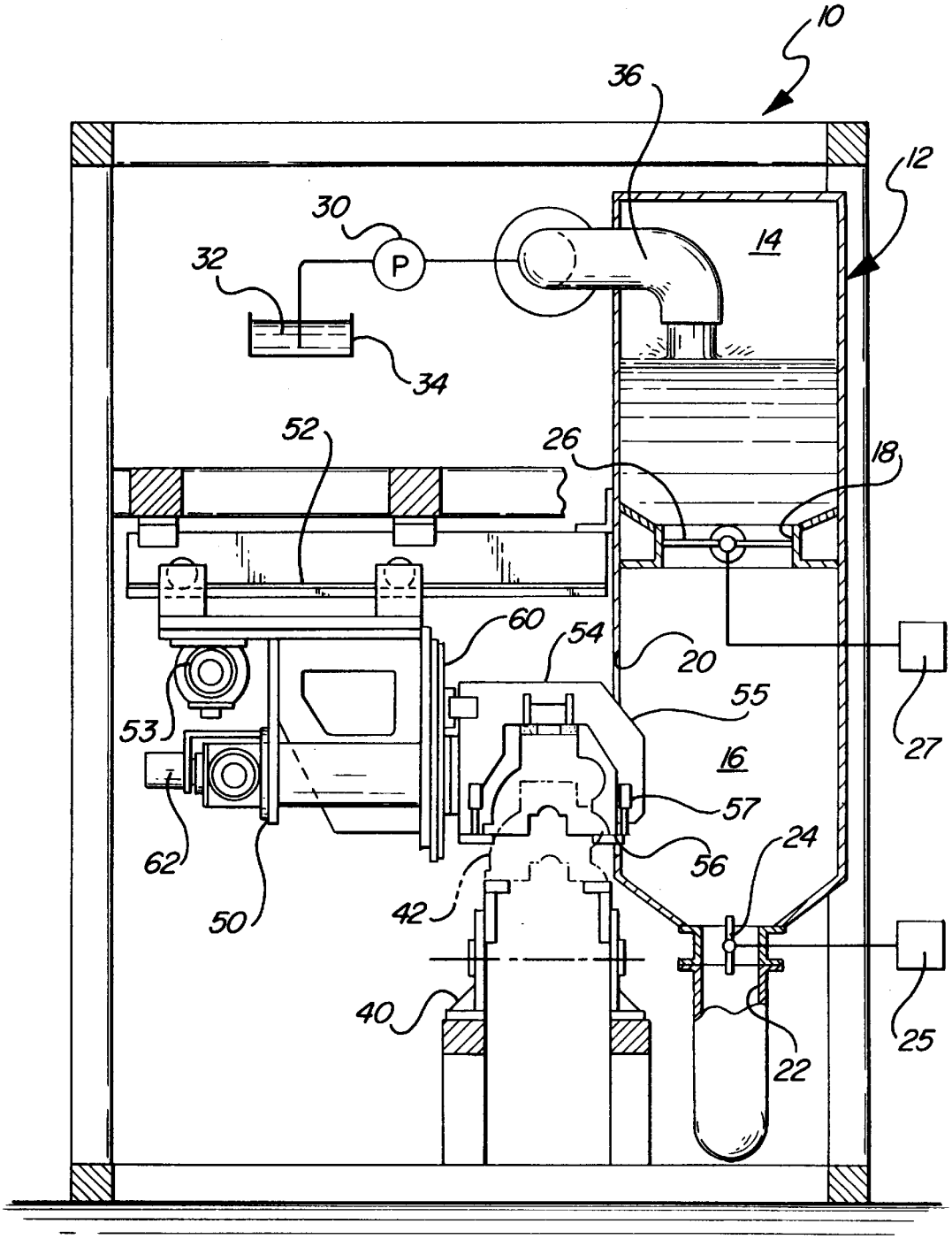
FIG. 2 is a diagrammatic end view of the preferred embodiment of the present invention and taken substantially along line 2—2 in FIG. 1 and illustrating the part washer in a load position.

With reference first to FIGS. 1 and 2 of the patent drawing, a preferred embodiment of the part washer 10 of the present invention is there shown and comprises a washer housing 12 defining an upper chamber 14 and a lower chamber 16. As best shown in FIG. 2, a fluid passageway 18 fluidly connects the chambers 14 and 16 together. The washer housing 12 is preferably rectangular in cross-sectional shape and includes a side opening 20 open to the lower chamber 16 for a reason to be subsequently described.

Figure 3:
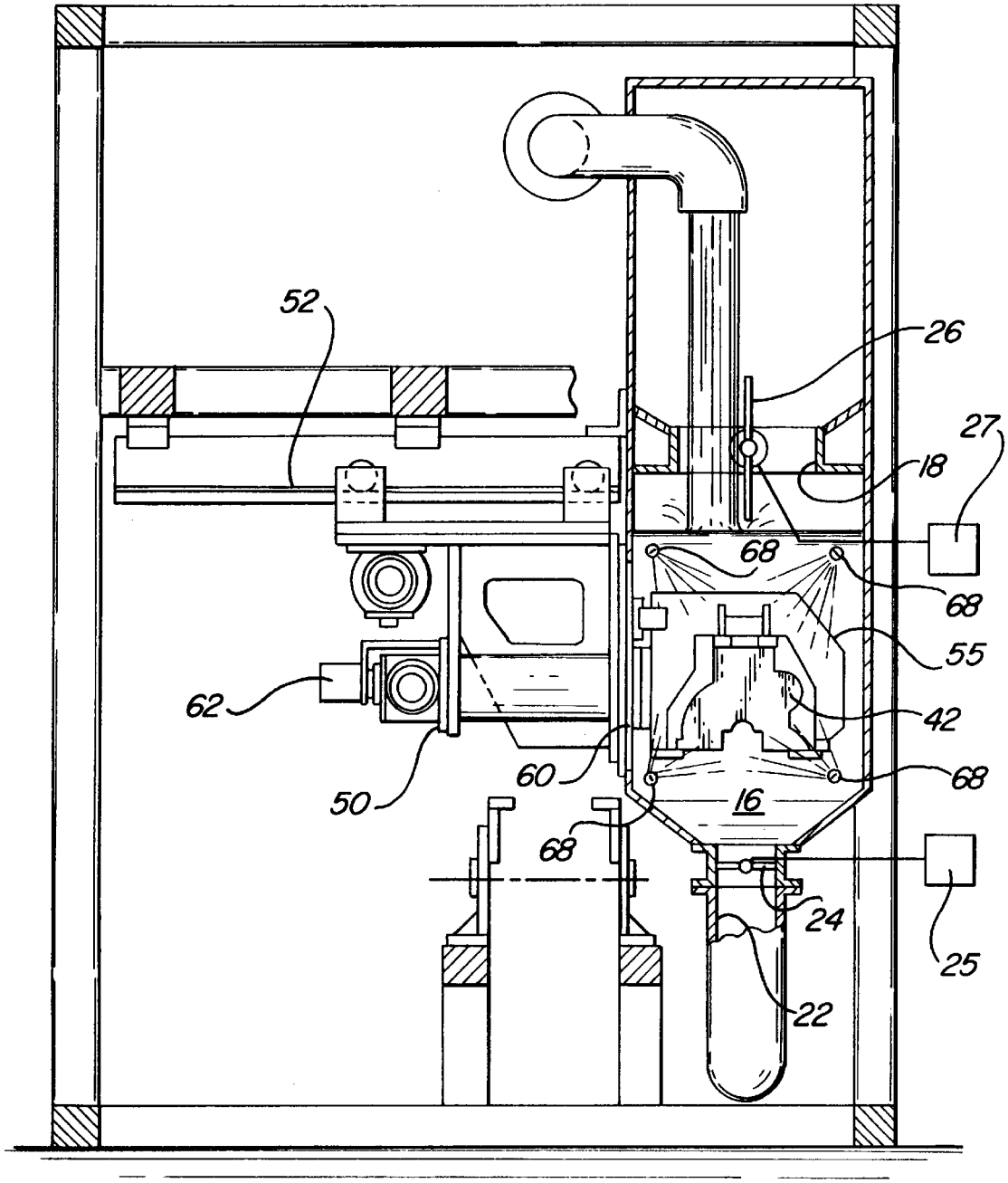
FIG. 3 is a view similar to FIG. 2 but illustrating the part washer in a wash position.

With reference now particularly to FIGS. 2 and 3, a fluid drain 22 is open to the bottom of the lower chamber 16. A drain valve 24 is fluidly connected in series with the drain 22 and is movable between an open position, illustrated in FIG. 2, and a closed position, illustrated in FIG. 3. A drain valve control system 25 controls the actuation of the drain valve.

A flood valve 26 is fluidly connected in series with the passageway 18 and is movable between a closed position, illustrated in FIG. 2, and an open position, illustrated in FIG. 3 by a flood valve control system 27. In its closed position, the flood valve 26 prevents, or at least greatly inhibits, fluid flow through the passageway 18. Conversely, in its open position (FIG. 3) the flood valve 26 enables free fluid flow through the passageway 18. Furthermore, the passageway 18 is relatively large in size thus permitting virtually unrestricted fluid flow from the upper chamber 14 and to the lower chamber 16 when the flood valve 26 is in its open position.

Referring again to FIG. 2, a pump 30 pumps a cleaning fluid 32, typically water, from a reservoir 34 (illustrated only diagrammatically) through a conduit 36 and into an upper portion of the upper chamber 14. As will be subsequently described in greater detail, during the operation of the part washer 10, the pump 30 is continuously operated such that the cleaning fluid is continuously pumped into the upper chamber 14.

With reference again to FIGS. 1 and 2, any conventional conveyor system 40, illustrated only diagrammatically, is utilized to sequentially move parts 42 to be washed to a load position adjacent the lower chamber 16 of the housing 12 and also adjacent the housing opening 20 (FIG. 2). Furthermore, the part 42 is illustrated in the drawing as an engine block for exemplary purposes only.

With reference now to FIGS. 2 and 3, the part washer 10 further includes a shuttle assembly 50 which is movable laterally with respect to the washer housing 12 between a retracted position, illustrated in FIG. 2, and an extended position, illustrated in FIG. 3. Any conventional means, such as a rack and pinion drive 52 and motor 53, can be used to move the shuttle 50 between this extended and retracted position.

Still referring to FIGS. 2 and 3, the shuttle assembly 50 includes a cradle frame assembly 54 for releasably engaging the part 42. The precise configuration of the cradle frame assembly 54 will vary depending upon the precise part. However, the cradle frame assembly 54 illustrated in the drawing includes a plurality of clamps 56 mounted to a frame 54 which, upon actuation, selectably engage preset points on the part 42 in order to secure the part to the cradle frame 54. Any conventional means 57, such as pneumatic, hydraulic, etc., may be used to actuate the clamps 56.

When the shuttle assembly 50 is moved to its extended position (FIG. 3) a plate 60 on the shuttle assembly 50 effectively closes the opening 20 in the washer chamber 12. Simultaneously, as shown in FIG. 3, the part 42 secured by the cradle frame assembly 54 is positioned within the lower chamber 16. Furthermore, an agitator 62 on the shuttle assembly 50, upon actuation, reciprocally rotatably drives the cradle frame assembly 54 and thus the part 42 as indicated by arrows 64 (FIG. 1).

As best shown in FIGS. 1 and 3, a plurality of spray jets 68 are contained within the lower chamber 16 of the washer housing 12. These jets 68 have their outlets directed generally into the interior of the lower chamber 16 and thus generally directed toward the part 42. These jets 68 are fluidly connected to a source of the cleaning fluid as well as a pump by any conventional means (not shown).

With reference first to FIGS. 1 and 2, the operation of the part washer 10 of the present invention will now be described. The complete operation cycle for the part washer of the present invention is subdivided into a loading cycle, a wash cycle and an unloading cycle. In brief, during the loading cycle, one part 42 is moved from the conveyor 40 and into the wash housing 12. During the wash cycle, the part is actually washed thus cleansing it of debris. Lastly, during the unloading cycle, the part is removed from the washer housing 12 and placed back on the conveyor 40. The entire process is then repeated.

With reference then to FIGS. 1 and 2, during a loading cycle, the conveyor 40 first conveys one part 42 to the loading position adjacent the lower chamber 16 and in alignment with the housing opening 20 as shown in FIG. 2. During the loading cycle, the drain valve 24 is in the open position while the flood valve 26 is in its closed position. Thus, the drain valve 24 removes the cleaning fluid and any contained debris from the lower chamber 16 while the pump 30 fills the upper chamber 14 with the cleaning fluid 32.

At the start of the load cycle of the operation cycle, the shuttle 50 is in its retracted position 50 as shown in FIG. 2. The cradle frame assembly 54 engages the part 42 by actuating the clamps 56 thus removing the part 42 from the conveyor 40. The shuttle assembly 50 is then moved to its extended position as shown in FIG. 3 thus completing the load cycle. At the completion of the load cycle, the shuttle plate 60 with its perimeter seal effectively closes the housing opening 20 and positions the part 42 in the lower chamber of the washer housing 12.

With reference now to FIG. 3, at the initiation of the wash cycle, the flood valve control system 27 actuates the flood valve 26 to its open position. Simultaneously, the drain valve control system 25 actuates the drain valve 24 to its closed position.

The actuation of the valves 26 and 24 to their open and closed positions, respectively, allows the cleaning fluid 32 that had accumulated in the upper chamber 14 during the previous load and unload cycles to at least partially fill the lower chamber 16 and immerse the part 42 in cleaning fluid as shown in FIG. 3. Simultaneously, the fluid jets 68 are actuated along with the shuttle agitator 62 thus subjecting the part 42 not only to reciprocal rotational agitation, but also to a whirlpool or fluid eddy created by the fluid jets 68. This combination effectively removes any debris contained in or on the part 42 to be washed from the part 42 such that the debris accumulates in the bottom of the lower chamber 16.

During the wash cycle, the fluid pump 30 (FIG. 2) continues to pump fresh or clean cleaning fluid into the upper chamber 14 of the housing 12. Preferably, the valve 26 is retained in an open position as shown in FIG. 3 so that the lower chamber 16 continues to fill with the cleaning fluid. The drain valve control system 25, however, periodically actuates the drain valve 24 to move it momentarily to an open position and subsequently return it to a closed position to drain some of the cleaning fluid along with entrained debris from lower chamber 16. However, during the complete washing cycle, the part 42 remains submerged in the cleaning fluid in the lower chamber 16.

Alternatively, the flood valve control system 27 actuates the flood valve 26 to cyclically move the flood valve 26 between an open and closed position either synchronously or asynchronously with the actuation of the drain valve 24. In either event, however, fresh cleaning fluid is continuously supplied to the lower chamber 16 during the wash cycle.

The actual duration of the wash cycle will vary depending upon the part. However, typically a wash cycle would extend between eighteen and ninety seconds.

With reference again to FIG. 2, the unload cycle immediately follows the wash cycle. At the initiation of the unload cycle, the flood valve control system 27 actuates the flood valve 26 to its closed position so that the upper chamber 14 begins filling with the cleaning fluid 32. Simultaneously, the drain valve control system 25 actuates the drain valve 24 to its open position thus draining substantially all of the cleaning fluid from the housing lower chamber 16.

After a small delay to enable the cleaning fluid to drain from the lower housing 16, the shuttle assembly 50 is actuated to move it to its retracted position as shown in FIG. 2 and so that the part 42 is again aligned with the conveyor 40. The cradle frame assembly 54 then actuates its clamps 56 to disengage from the part 42 and release the part 42 onto the conveyor system 40. The conveyor system 40 is then actuated to move the next sequential part 42 to the load position whereupon the above-described operation cycle is again repeated.

From the foregoing, it can be seen that the part washer of the present invention provides a simple and yet highly effective part washer for industrial parts.

Having described my invention, however, many modifications thereto will become apparent to those skilled in the art to which it pertains without deviation from the spirit of the invention as defined by the scope of the appended claims.

I claim:

1. A part washer comprising:

a washer housing having an upper chamber, a lower chamber and a fluid passageway connecting said chambers together, a fluid drain connected to said lower chamber, means for pumping a cleaning fluid into said upper chamber, a flood valve positioned in said fluid passageway and movable between an open and a closed position, means for sequentially moving parts to a position adjacent said washer housing, means for selectively loading and, after a wash cycle, subsequently unloading parts into said lower chamber, means for closing said flood valve during loading and unloading of said parts and for opening said flood valve during at least a portion of said wash cycle, and wherein said loading and unloading means comprises a shuttle movable laterally between a retracted and an extended position, said shuttle registering with an opening in said washer housing, means at an end of said shuttle adjacent said washer housing and operable while said shuttle is in said retracted position for releasibly engaging a part, said shuttle moving said part through said washer housing opening and into said lower chamber as said shuttle moves from said retracted to said extended position.

2. The invention as defined in claim 1 and comprising a plurality of fluid jets open to said lower chamber.

3. The invention as defined in claim 1 and comprising means for agitating said part in said lower chamber during said wash cycle.

4. The invention as defined in claim 3 wherein said agitating means comprises means for reciprocally rotating said part during said wash cycle.

5. The invention as defined in claim 1 and comprising means carried by said shuttle for closing said washer housing opening when said shuttle is in said extended position.

6. The invention as defined in claim 1 and comprising a drain valve fluidly connected in said drain and movable between and open and a closed position, and means for moving said drain valve to an open position at the conclusion of said wash cycle.

7. The invention as defined in claim 6 and comprising means for cyclically opening and closing said drain valve during said wash cycle.

8. The invention as defined in claim 6 and comprising means for cyclically opening and closing said flood valve during said wash cycle.

9. The invention as defined in claim 1 and comprising a conveyor means for moving sequential parts to a position adjacent said washer housing.

10. A part washer comprising:

a washer housing having an upper chamber, a lower chamber and a fluid passageway connecting said chambers together, a fluid drain connected to said lower chamber, means for pumping a cleaning fluid into said upper chamber, a flood valve positioned in said fluid passageway and movable between an open and a closed position, means for sequentially moving parts to a position adjacent said washer housing, means for selectively loading and, after a wash cycle, subsequently unloading parts into said lower chamber, means for closing said flood valve during loading and unloading of said parts and for opening said flood valve during at least a portion of said wash cycle, a drain valve fluidly connected in said drain and movable between and open and a closed position, and means for moving said drain valve to an open position at the conclusion of said wash cycle, and means for cyclically opening and closing said drain valve during said wash cycle.

11. The invention as defined in claim 10 and comprising a plurality of fluid jets open to said lower chamber.

12. The invention as defined in claim 10 and comprising a conveyor means for moving sequential parts to a position adjacent said washer housing.

13. A part washer comprising:

a washer housing having an upper chamber, a lower chamber and a fluid passageway connecting said chambers together, a fluid drain connected to said lower chamber, means for pumping a cleaning fluid into said upper chamber, a flood valve positioned in said fluid passageway and movable between an open and a closed position, means for sequentially moving parts to a position adjacent said washer housing, means for selectively loading and, after a wash cycle, subsequently unloading parts into said lower chamber, means for closing said flood valve during loading and unloading of said parts and for opening said flood valve during at least a portion of said wash cycle, a drain valve fluidly connected in said drain and movable between and open and a closed position, and means for moving said drain valve to an open position at the conclusion of said wash cycle, and means for cyclically opening and closing said flood valve during said wash cycle.

14. The invention as defined in claim 13 and comprising a plurality of fluid jets open to said lower chamber.

15. The invention as defined in claim 13 and comprising a conveyor means for moving sequential parts to a position adjacent said washer housing.

* * * * *